US011242853B2

(12) United States Patent
Dieckmann

(10) Patent No.: US 11,242,853 B2
(45) Date of Patent: Feb. 8, 2022

(54) LIQUID REFRIGERANT PUMP HAVING SINGLE FIXED SCROLL AND TWO NON-CONTACTING ORBITING SCROLLS TO PUMP FLUID AND PROVIDE PRESSURIZED FLUID TO THRUST BEARING AREA

(71) Applicant: TIAX LLC, Lexington, MA (US)

(72) Inventor: John Dieckmann, Lexington, MA (US)

(73) Assignee: TIAX LLC, Lexington, MA (US)

( * ) Notice: Subject to any disclaimer, the term of this patent is extended or adjusted under 35 U.S.C. 154(b) by 54 days.

(21) Appl. No.: 16/530,158

(22) Filed: Aug. 2, 2019

(65) Prior Publication Data

US 2020/0040892 A1 Feb. 6, 2020

Related U.S. Application Data

(60) Provisional application No. 62/713,703, filed on Aug. 2, 2018.

(51) Int. Cl.
*F04C 18/02* (2006.01)

(52) U.S. Cl.
CPC ..... *F04C 18/0215* (2013.01); *F04C 2230/91* (2013.01); *F04C 2240/40* (2013.01); *F04C 2240/50* (2013.01); *F04C 2240/60* (2013.01); *F05C 2203/08* (2013.01)

(58) Field of Classification Search
CPC ..... F04C 18/0215; F04C 2240/40; F04C 2240/60; F04C 2240/50; F04C 2230/91; F04C 29/045; F04C 2240/52; F04C 18/0276; F04C 2/025; F04C 18/0246; F04C 18/0269; F05C 2203/08; F01C 1/0223
See application file for complete search history.

(56) References Cited

U.S. PATENT DOCUMENTS 4,141,677 A * 2/1979 Weaver ..... F01C 1/0246 418/6
4,958,993 A * 9/1990 Fujio ..... F04C 27/005 418/55.3
5,145,344 A * 9/1992 Haga ..... F01C 1/0223 418/55.2
5,252,046 A 10/1993 Wen-Ding et al.
5,951,270 A 9/1999 DuMoulin et al.
(Continued)

FOREIGN PATENT DOCUMENTS

JP 2000088381 A * 3/2000 ..... H04B 1/40
JP 2012052527 A * 3/2012 ..... F01C 1/0215
(Continued)

OTHER PUBLICATIONS

Derwent English Abstract of JP 2000088381A (Year: 2000).*

*Primary Examiner* — Mary Davis
*Assistant Examiner* — Paul W Thiede
(74) *Attorney, Agent, or Firm* — Dinsmore & Shohl, LLP

(57) ABSTRACT

A pump as provided includes an inlet, an outlet, and a scroll pumping element. The scroll pumping element includes a fixed scroll component having one or more fixed scrolls and orbiting scroll component having one or more orbiting scrolls for fluid pumping. The fixed scroll component and the orbiting scroll component are arranged so as to be capable of providing pressurized fluid to a thrust bearing and prevent contact between the fixed scroll component and the orbiting scroll component.

16 Claims, 3 Drawing Sheets

(56) References Cited

U.S. PATENT DOCUMENTS

| | | | | |
|---|---|---|---|---|
| 6,659,743 | B2 * | 12/2003 | Kimura | F04C 18/0269 418/55.2 |
| 6,736,620 | B2 * | 5/2004 | Satoh | F04C 18/0261 418/15 |
| 7,001,161 | B2 * | 2/2006 | Kimura | F04C 18/0261 418/55.2 |
| 7,014,434 | B2 * | 3/2006 | Fujioka | F04C 23/001 418/15 |
| 7,861,541 | B2 * | 1/2011 | Dieckmann | F01C 19/08 62/87 |
| 2009/0110581 | A1 * | 4/2009 | Fontaine | F16C 33/1095 418/55.3 |
| 2013/0302184 | A1 * | 11/2013 | Sishtla | F04D 13/0606 417/53 |
| 2015/0167672 | A1 * | 6/2015 | Stones | F04C 23/003 418/55.2 |
| 2015/0322947 | A1 | 11/2015 | Takai et al. | |
| 2016/0054040 | A1 * | 2/2016 | Jonsson | F25B 45/00 62/115 |

FOREIGN PATENT DOCUMENTS

| | | | |
|---|---|---|---|
| JP | 2015203337 | A | 11/2015 |
| KR | 101451663 | B1 | 10/2014 |

* cited by examiner

LIQUID REFRIGERANT PUMP HAVING SINGLE FIXED SCROLL AND TWO NON-CONTACTING ORBITING SCROLLS TO PUMP FLUID AND PROVIDE PRESSURIZED FLUID TO THRUST BEARING AREA

CROSS REFERENCE TO RELATED APPLICATIONS

This application depends from and claims priority to U.S. Provisional Application No. 62/713,703 filed Aug. 2, 2018, the entire contents of which are incorporated herein by reference.

FIELD

This disclosure relates to pumping low viscosity, non-lubricating fluids, and more particularly to a scroll technology based pump for refrigerants such as liquid fluorocarbons and similar fluids for a variety of heat transfer, refrigeration, and space conditioning applications.

BACKGROUND

Low viscosity, non-lubricating liquids, such as fluorocarbon refrigerants, are notoriously difficult to pump, especially when the application requires the pump to significantly increase the liquid pressure with the liquid at the pump inlet being minimally subcooled (i.e., in pump industry terminology, have a minimal net positive suction head, typically abbreviated as NPSH) and that the liquid being pumped not be mixed with or contaminated by a separate lubricant. The challenges of pumping in this regime are well known. For example, the common fluorocarbon refrigerants and heat transfer fluids are generally low in liquid viscosity and offer no boundary lubrication type lubricity making mechanical design of a pump to handle these fluids challenging with respect to both mechanical friction losses and the wear life of rotating shafts, bearings, and pump elements. In addition, many potential applications of refrigerant pumps require that the liquid be minimally subcooled so there is minimal net positive suction head. Many pump types are highly susceptible to cavitation under these conditions, leading to rough operation, poor performance, erosion, and ultimate destruction of pump elements, especially centrifugal pump impellers.

Nevertheless, there are several potential applications for a liquid pump of this type. For example, in two-phase heat transfer loops, a liquid refrigerant is pumped to one or more heat exchangers to cool various components. A portion of the liquid evaporates in each heat exchanger, with the heat of vaporization of the evaporated liquid absorbing the cooling load from that heat exchanger. Significantly more heat can be carried in relationship to the mass flow rate of heat transfer fluid and at constant temperature. Before returning to the pump, the two phases (vapor and the remaining unevaporated liquid) pass through a condenser, typically returning to the pump as a liquid with minimal subcooling. The amount of pressure rise needed to force the liquid flow around the loop depends of the overall size and length of the loop and the type of flow control devices that are used.

With the growth of the internet and information storage, the energy consumption for cooling data centers has become significant, on a par with the electrical energy consumption of the servers, themselves. The so-called liquid refrigerant economizer cycle can save significant amounts of cooling energy, especially in cooler climates. The liquid refrigerant economizer cycle is implemented by adding a liquid refrigerant pump to the typical data center cooling equipment. When the outdoor temperature is cool enough, typically below 45 degrees Fahrenheit (° F.), refrigerant vapor from the evaporators bypasses the refrigerant compressors and condenses directly in the condenser. The condensed refrigerant, again typically with minimal subcooling, must be pumped back to the evaporators with enough pressure to force the refrigerant though the expansion devices.

Another potential application is for pumping liquid refrigerant in a supermarket refrigeration system with fully floating head pressure, as low as the outdoor ambient temperature will allow. With extremely low condensing temperature and pressure, a liquid pump is needed to raise the liquid pressure high enough to pass through normally sized expansion valves. With this arrangement, a Watt of pump power will save on the order of 25 Watts of compressor power, compared to conventional head pressure control that does not allow the condensing temperature to fall below 75° F.

As such, there is a need for new pumps or pumping systems suitable for addressing the foregoing challenges and uses.

SUMMARY

The following summary is provided to facilitate an understanding of some of the innovative features unique to the present disclosure and is not intended to be a full description. A full appreciation of the various aspects of the disclosure can be gained by taking the entire specification, claims, drawings, and abstract as a whole.

In a first aspect A1, a pump includes an inlet, an outlet, and a scroll pumping element. The scroll pumping element includes a fixed scroll component having one or more fixed scrolls and orbiting scroll component having one or more orbiting scrolls for fluid pumping where the fixed scroll component and the orbiting scroll component are arranged so as to be capable of providing pressurized fluid to a thrust bearing and prevent contact between the fixed scroll component and the orbiting scrolls component.

A second aspect A2 includes the pump of the first aspect A1 where a wrap length of the one or more orbiting scrolls is 0.75 wraps to 1.25 wraps long, and a wrap length of the one or more fixed scrolls is 1.75 wraps to 2.25 wraps long.

A third aspect A3 includes the pump of the first aspect A1 where a wrap length of the one or more orbiting scrolls is one wrap long and a wrap length of the one or more fixed scrolls is two wraps long.

A fourth aspect A4 includes the pump of the first aspect A1 and further includes an Oldham coupling associated with the orbiting scroll component.

A fifth aspect A5 includes the pump of the fourth aspect A4 wherein the Oldham coupling includes a wear resistant coating A sixth aspect A6 includes the pump of the fifth aspect wherein the wear resistant coating is or includes hard anodized aluminum.

A seventh aspect A7 includes the pump of any of the first-sixth aspects A1-A6 further including an orbital drive mechanism in fluid communication with the outlet, wherein the orbital drive mechanism includes a drive shaft, two drive shaft bearings that support the drive shaft, and a radially compliant crank mechanism associated with the drive shaft.

An eighth aspect A8 includes the pump of the seventh aspect A7 wherein the drive shaft bearings are radial ball bearings with ceramic balls.

An ninth aspect A9 includes the pump of the seventh aspect A7 further including an orbiting scroll bearing between the radially compliant crank mechanism and the orbiting scroll component.

A tenth aspect A10 includes the pump of the ninth aspect A9 wherein the orbital scroll bearing is a radial ball bearing with ceramic balls.

An eleventh aspect A11 includes the pump of any of the first-tenth aspects A1-A10 and further includes an electric drive motor mechanically coupled to the orbital drive mechanism.

A twelfth aspect A12 includes the pump of the eleventh aspect A11 where the electric drive motor is hermetically enclosed within a fluid space.

A thirteenth aspect A13 includes the pump of the eleventh aspect A11 and further includes a second fluid outlet allowing fluid flow through the electric drive motor.

A fourteenth aspect A14 includes the pump of any of the first to the thirteenth aspects A1-A13 where the orbital drive mechanism includes a drive shaft and the electric drive motor is mechanically coupled to the drive shaft and is located outside a pressure-tight housing.

A fifteenth aspect A15 includes the pump of any of the first-fourteenth aspects A1-A14 where the fixed scroll component and the orbiting scroll component each have wear-resistant surfaces.

A sixteenth aspect A16 includes the pump of the fifteenth aspect A15 where the wear-resistant surfaces comprise or consist of hard anodized aluminum.

BRIEF DESCRIPTION OF THE DRAWINGS

The aspects set forth in the drawings are illustrative and exemplary in nature and not intended to limit the subject matter defined by the claims. The following detailed description of the illustrative aspects can be understood when read in conjunction with the following drawings, where like structure is indicated with like reference numerals and in which:

DETAILED DESCRIPTION

Figure 1:
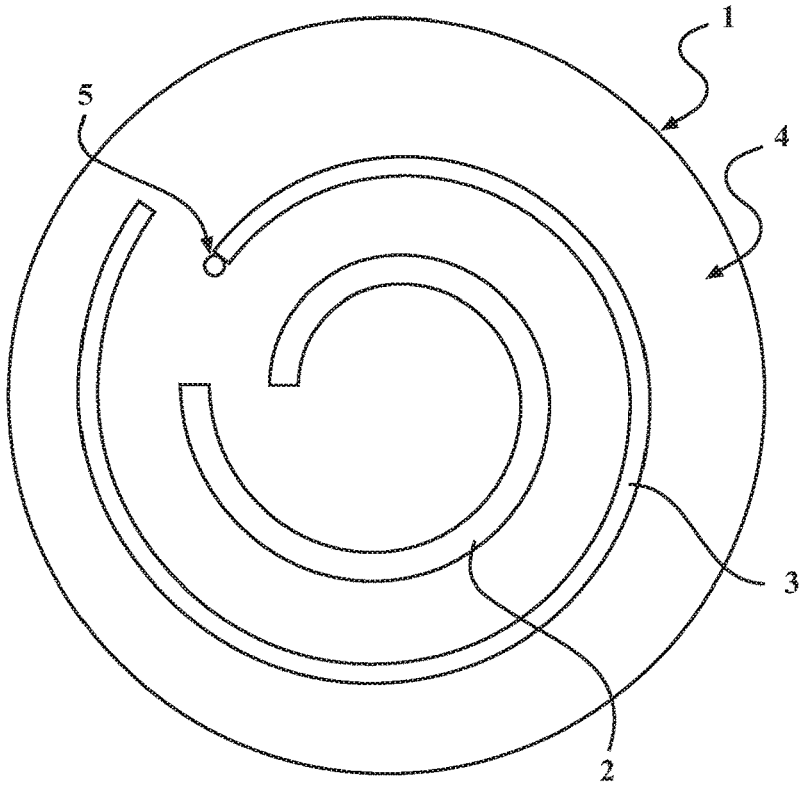
FIG. 1 illustrates a plan view of an orbiting scroll component according to some aspects as provided herein.

Provided in this disclosure are scroll type pumps capable of meeting the need for a pump that can handle minimally subcooled liquid refrigerants and similar heat transfer fluids. Scroll machines, particularly scroll refrigerant compressors, have a well-established track record of easily handling two-phase flows, for example, in the form of slugs of liquid refrigerant ingested into a scroll refrigerant compressor. These pass harmlessly through the scroll elements. The scroll pumps as provided herein capitalize on the relative motion between a meshed pair of scrolls that move in an orbital motion, with one scroll orbiting in a small circle and at low velocity relative to the other scroll. At these low relative velocities, it was found that there is minimal susceptibility to damage due to cavitation.

The basic advantages of scroll type pumps as provided herein include a self porting at the inlet and outlet, so intake and discharge valves are not needed. In addition, the circular orbital motion of the moving scroll can be dynamically balanced. The pumps are capable of providing continuous fluid flow. Within the provided pumps, the fluid pockets formed by the scroll form a trailing hydrodynamic wedge, providing robust hydrodynamic lubrication, despite the low viscosity of the liquid that may be typically used with the provided pump designs. Also, the scroll machinery used in aspects of the provided pumps is scalable over a wide range of flow capacities, so a scroll pump family developed for this purpose will be able to meet a wide range of needs.

The scroll type pump design as provided in this disclosure can operate reliably and for a long life under the aforementioned conditions. The disclosed scroll-type pump is capable of pumping fluids with minimal subcooling (NPSH). In prototype tests, fluid flows did not decrease as the inlet subcooling of fluorocarbon fluid R-134a was reduced from 20° F. to 2° F. Even with only 1° F. of subcooling, the pump mass flow was only reduced by 20%.

The essence of the mechanical design challenge is to drive the orbital motion of the orbiting scroll component in a manner that keeps close clearance between the active fluid pumping surfaces of the two scroll elements while avoiding or minimizing contact that leads to friction and wear. There are five sets of surfaces having mechanically loaded relative motion within a scroll pumping device according to some aspects:

- The axially facing surfaces of the scroll elements (involving large fluid pressure forces)
- The radially oriented contact between the sidewall (i.e., flanks) of the scrolls (involving modest pressure and inertial forces)
- The sliding contact between the keys and slots of the Oldham coupling, assuming an Oldham coupling is used to maintain the correct angular alignment of one scroll with respect to the other (involving modest pressure and inertial forces).
- The rotating bearing that translates the rotational motion of the drive shaft to orbital motion of the orbiting scroll component (the "scroll drive bearing", heavily loaded)
- The rotating bearings that support the drive shaft (heavily loaded)

The axial (tip) clearances between the two scroll elements are minimized by applying the pump discharge pressure to the space containing the orbital drive mechanism, resulting in this same pressure being applied to back side of the orbiting scroll component, pushing it against the fixed scroll component. The tip clearances are then reduced to those resulting from the dimensional tolerances to which the axially facing surfaces of the two scrolls have been manufactured. However this results in a large contact force between the two scroll elements that would cause excessive friction loss and wear. A thin film of the liquid being pumped is provided by incorporating a second pair of scroll elements on the two scroll parts that has the sole purpose of pumping enough fluid into the thrust bearing area of the two scroll parts to provide that thin film. The fluid film thickness is generally less than 0.001 inch (25 microns) and the average axial clearances between the two pumping scrolls are similar.

The modest radial contact forces between the two scrolls are managed by the aforementioned hydrodynamic wedge that exists at each flank contact point between the two scrolls.

The fluid film resulting from the sliding motion and load reversals are sufficient to handle the modest loads on the Oldham keys.

The shaft bearings and the scroll drive bearing are heavily loaded. In the non-lubricating, low viscosity fluid environment of the orbital drive mechanism, ceramic ball bearing with hardened steel races and silicon nitride ceramic balls are used. Metal balls in standard non-lubricated bearings tend to fail by chips falling off the balls as wear occurs and welding to the races, whereas the silicon nitrite ceramic balls do not have this failure mechanism.

To minimize the disruption of occasional breakdown of fluid films, the critical parts optionally have a wear resistant, optionally self-lubricating coating or surface treatment. Optionally, the two scroll elements and the Oldham ring have been fabricated from an aluminum alloy and the surfaces have been hard anodized and impregnated with polytetrafluoroethylene (PTFE).

Figure 5:
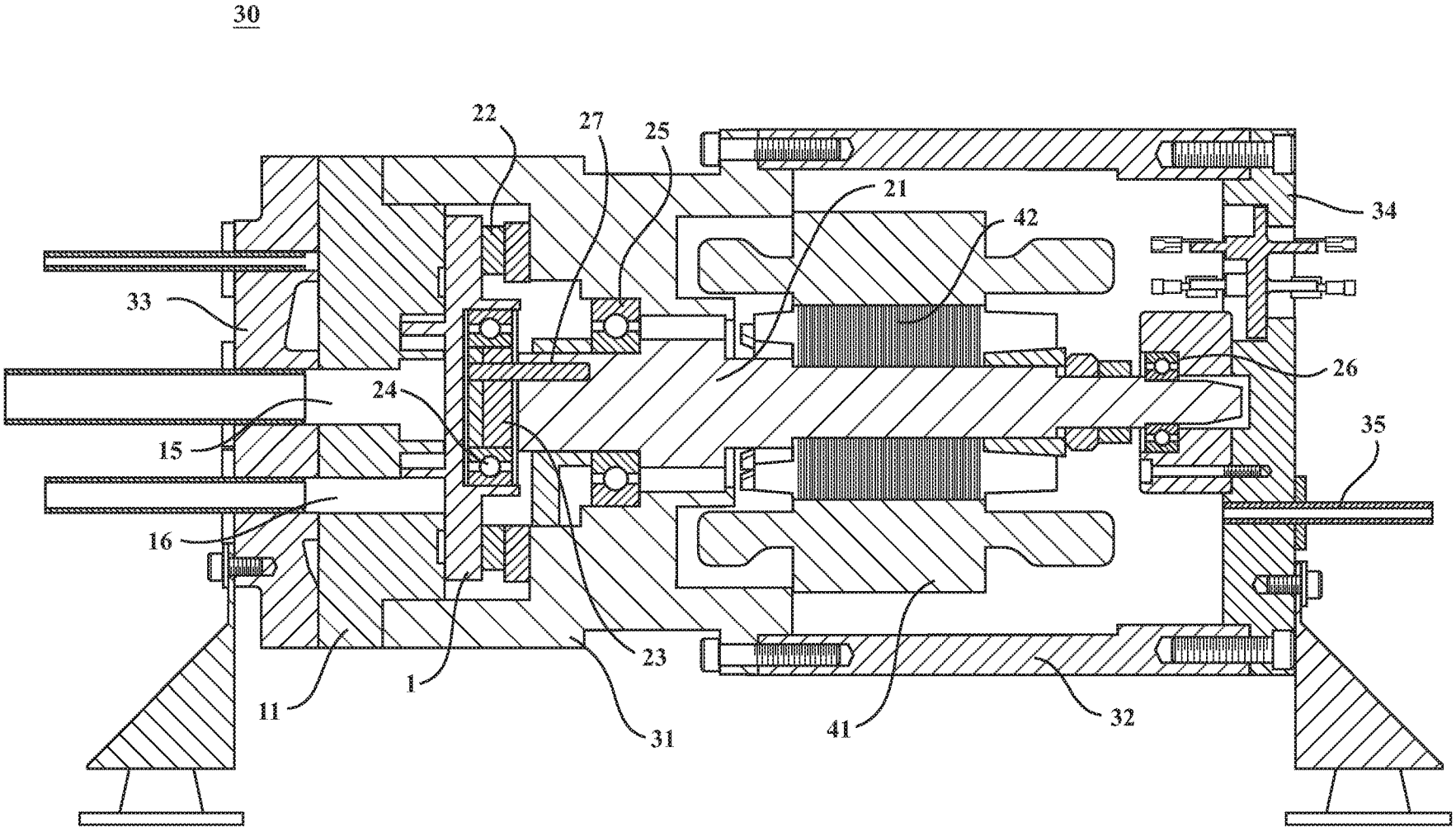
FIG. 5 illustrates an exemplary cross section of a pump assembly according to some aspects as provided herein.

FIG. 1 shows a plan view of the orbiting scroll component 1, comprising inner pumping scroll 2 and outer thrust bearing scroll 3. Orbiting scrolls 2 and 3 project from base plane 4 (e.g., also referred to as an orbiting base plate) that also acts as one surface of the fluid film thrust bearing. Through hole 5 provides fluid communication between the liquid being pumped and the space enclosing the orbital drive mechanism (FIG. 5).

Figure 2:
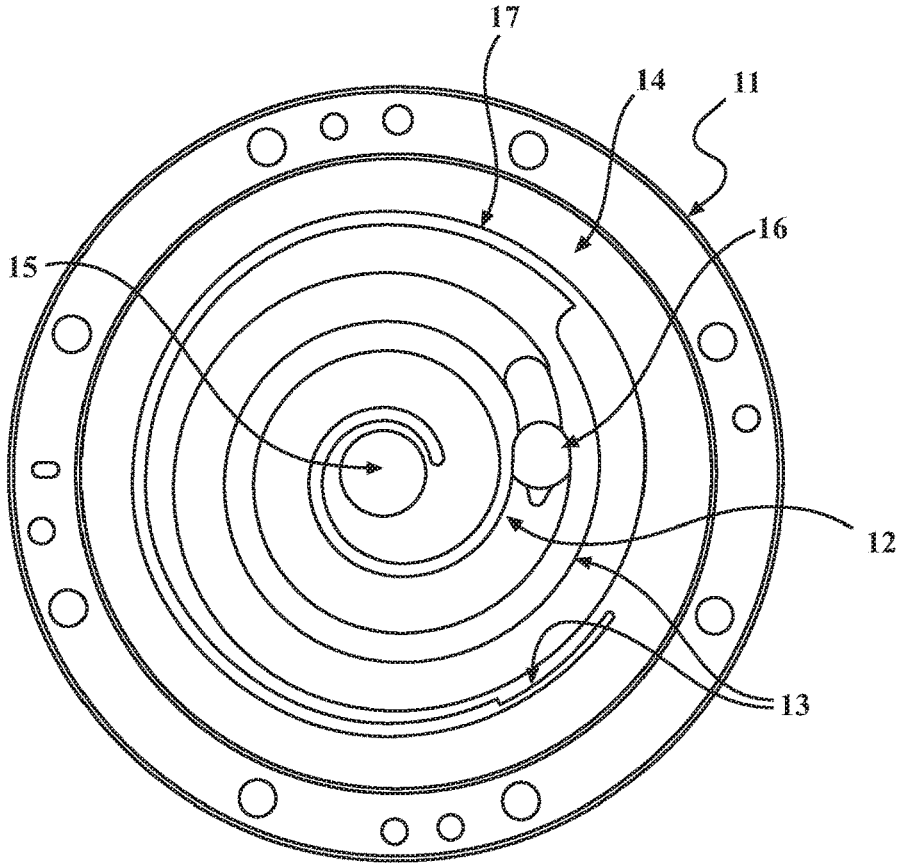
FIG. 2 illustrates a plan view of a fixed scroll component according to some aspects as provided herein.

FIG. 2 shows a plan view of the fixed scroll component 11, comprising inner pumping scroll 12 and outer thrust bearing scroll 13. The tips of scrolls 12 and 13 are coplanar with each other and with thrust bearing surface 14. Hole (inlet) 15 is the liquid inlet and hole (outlet) 16 is the liquid outlet. Groove 17 distributes pressurized fluid uniformly over the thrust bearing surface 14.

Referring to both FIGS. 1 and 2, the inner pumping scroll set includes the inner pumping scroll 2 of the orbiting scroll component 1 (FIG. 1) and the inner pumping scroll 12 of the fixed scroll component 11 (FIG. 2) and the outer thrust bearing scroll set includes the outer thrust bearing scroll 3 of the orbiting scroll component 1 (FIG. 1) and the outer thrust bearing scroll 13 of the fixed scroll component 11 (FIG. 2). The inner pumping scroll 2 and/or the outer thrust bearing scroll 3 of the orbiting scroll component 1 (FIG. 1) is optionally one wrap in length. The inner pumping scroll 12 and/or the outer thrust bearing scroll 13 of the mating fixed scroll component 11 is optionally 2 wraps in length. The inner pumping scroll 2 and/or the outer thrust bearing scroll 3 of the orbiting scroll component 1 may be generally referred to as "one or more orbiting scrolls." Similarly, the inner pumping scroll 12 and/or the outer thrust bearing scroll 13 of the fixed scroll component 11 may be generally referred to as "one or more fixed scrolls."

This asymmetric configuration results in minimal flow variation with orbital position and minimal variation in the axial pressure forces carried by the thrust bearing. In some aspects the wrap length of the inner pumping scroll 2 and/or the outer thrust bearing scroll 3 of the orbiting scroll component 1 (FIG. 1) is from 0.75 wraps to 1.25 wraps in length and the wrap length of the inner pumping scroll 12 and/or the outer thrust bearing scroll 13 of the fixed scroll component 11 (FIG. 2) is from 1.75 to 2.25 wraps in length.

Figure 3:
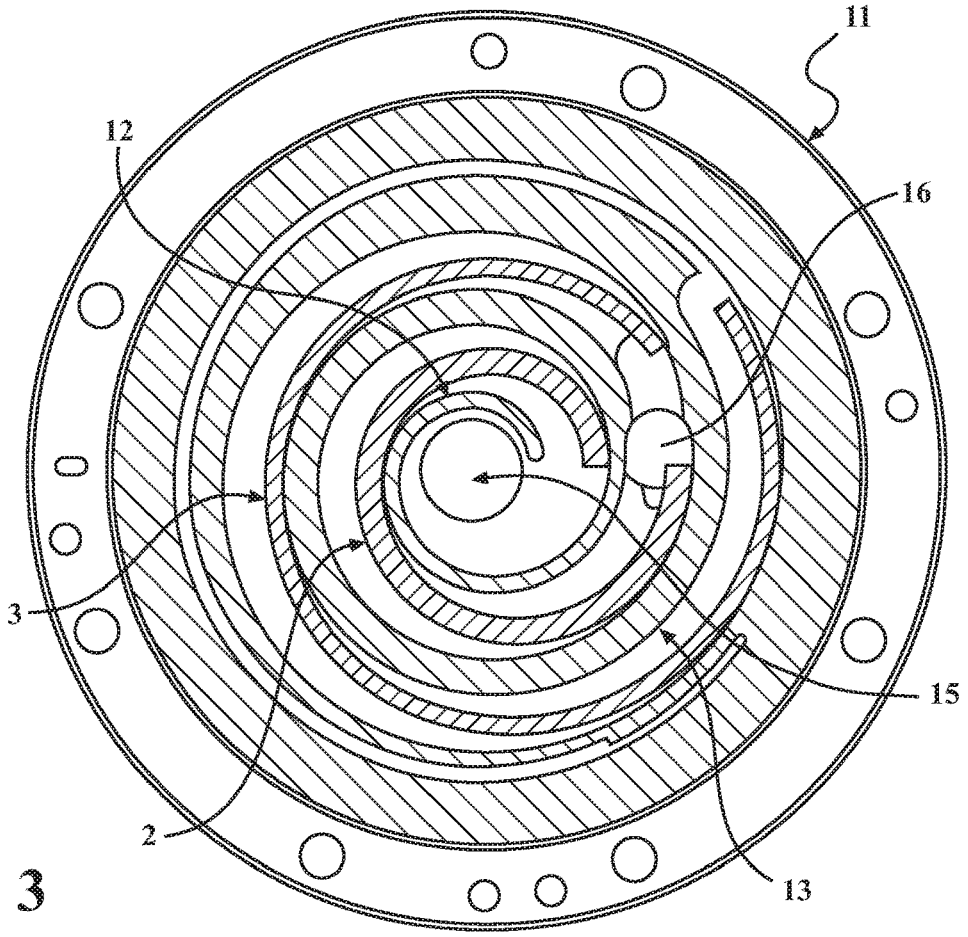
FIG. 3 illustrates fixed and orbiting scroll components meshed together according to some aspects as provided herein.

FIG. 3 shows a plan section of the orbiting scroll component 1 (FIG. 1) as assembled with the fixed scroll component 11 (FIG. 2) in one exemplary representative orbital position. Orbiting scroll component 1 (not shown in FIG. 3) orbits in a counterclockwise direction. This orbital motion of inner pumping scroll 2, which moves in response to the motion of the orbiting scroll component 1, within the inner pumping scroll 12 of the fixed scroll component 11 transfers fluid from inlet 15 to outlet 16. The coincident orbital motion of the outer orbiting scroll 3 of the orbiting scroll component 1 (FIG. 1) within the outer thrust bearing scroll 13 of the fixed scroll component 11 causes fluid to be pumped onto thrust bearing surface 14 (FIG. 2), providing a thin fluid film separating the base plane 4 (FIG. 1) of the orbiting scroll component 1 (FIG. 1) and the fixed scroll surface 14 by approximately 0.0005 inches (12 microns), preventing wear and minimizing friction.

Figure 4:
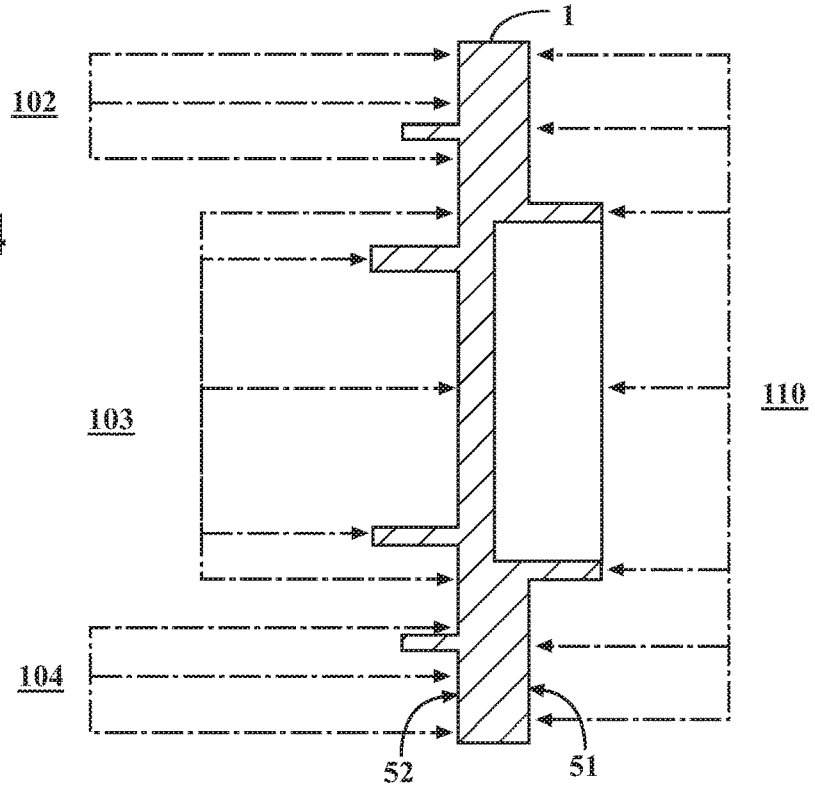
FIG. 4 illustrates exemplary axial pressure balance on the orbiting scroll component according to some aspects as provided herein.

FIG. 4 illustrates a cross-sectional view of the orbiting scroll component 1 as depicted in FIG. 1. The illustration in FIG. 4 depicts the resulting axial pressure force balance on the orbiting scroll component 1 according to some aspects as provided herein. The orbiting scroll component 1 is positioned by the net effect of the fluid pressures acting on the first side 51 facing the orbital drive mechanism and the second side 52 facing the scroll pumping elements. Pump outlet pressure is admitted to the orbital drive unit via hole 5 (FIG. 1) and acts on all of side 51. Force lines 110 depict the forces due to the pump outlet pressure acting on the first side 51 of the orbiting scroll component 1. On side 52 of the orbiting scroll component 1, the fluid pumping region formed by the inner pumping scroll set which includes the inner pumping scroll 2 of the orbiting scroll component 1 and the inner pumping scroll 12 of the fixed scroll component 11 (FIGS. 2 and 5) generates a pump inlet pressure depicted by force lines 103 that acts on a portion of the orbiting scroll component 1 and pump outlet pressure acts on the remaining area defined by the force lines 103. Outside of the pumping scrolls, the outer thrust bearing scroll set that includes the outer thrust bearing scroll 3 of the orbiting scroll component 1 and the outer thrust bearing scroll 13 of the fixed scroll component 11 (FIGS. 2 and 5) pump enough fluid into the thrust bearing gap between the surfaces of base plane 4 (FIG. 1) and the thrust bearing surface 14 (FIG. 2) to generate a pressure (i.e., depicted by force lines 102 and 104) sufficient to counterbalance the outlet pressure force 110 acting on side 51.

FIG. 5 shows a horizontal cross section of a pump 30 according to some aspects as provided herein. The pump 30 is configured to pump liquid, for example without limitation, low viscosity, non-lubricating liquids, such as fluorocarbon refrigerants. The pump 30 is not limited to pumping refrigerants. In some embodiments, the pump 30 may be described by way of three general components: a scroll pumping element, an orbital drive mechanism, and an electric drive motor. Each of the components, the scroll pumping element, the orbital drive mechanism, and the electric drive motor are mechanically, rotationally, and/or fluidly coupled to each other.

The scroll pumping element is coupled to an inlet 15 and an outlet 16 formed with a scroll end cover 33. The scroll pumping element is further coupled to an orbital drive housing 31. The orbital drive housing 31 may be configured as a pressure-tight housing coupled to the scroll end cover 33 and the fixed scroll component 11. The scroll pumping element includes the fixed scroll component 11 and the orbiting scroll component 1 for fluid pumping. The fixed scroll component 11 and the orbiting scroll component 1 are arranged so as to be capable of providing pressurized fluid to a thrust bearing and prevent contact between surfaces of the fixed scroll component 11 and the orbiting scroll component 1. In some embodiments, the orbiting scroll component 1 and the fixed scroll component 11 are disposed within a liquid tight housing that includes the orbital drive housing 31, the motor housing 32, the scroll end cover 33, and motor end cover 34. A second outlet 35, which, for example, is configured with the motor end cover 34, provides means for a portion of the pumped liquid flow to pass around the motor stator 41 and through the gap between the motor stator 41 and the motor rotor 42, cooling the electric drive motor.

The orbital drive mechanism is in fluid communication with the outlet 16 of the scroll pumping element. The orbital drive mechanism includes a drive shaft 21, one or more drive shaft bearings 25 and 26 that support the drive shaft 21. The orbital drive mechanism may further include a radially compliant crank mechanism 23 coupled to the drive shaft 21 via a pivot pin 27, which in turn drives the orbital motion of the orbiting scroll component 1 via orbital scroll bearing 24. An Oldham coupling 22 may also be included in the orbital drive mechanism. The Oldham coupling 22 maintains the correct angular alignment of orbiting scroll component 1 with respect to fixed scroll component 11.

As discussed above the Oldham coupling may have a wear-resistant coating such as a hard anodized aluminum. Additionally, the drive shaft bearings 25 and 26 and/or the orbital scroll bearing 24 may be radial ball bearings. The radial ball bearings may be ceramic balls, for example silicon nitride ceramic balls, or the like that are configured within hardened steel races. In some embodiments, the fixed scroll component 11 and/or the orbiting scroll component 1 may each have wear-resistant surfaces. The wear resistant surfaces may include hard anodized aluminum.

Still referring to the pump in FIG. 5, the electric drive motor includes a motor stator 41 and a motor rotor 42. The motor rotor 42 may be coupled to the drive shaft 21. That is, as the motor stator 41 induces an electro-magnetic field the motor rotor 42 is driven to rotate thereby rotating the drive shaft 21. The electric drive motor is mechanically coupled to the orbital drive mechanism. In some embodiments, the motor housing is fluidly coupled to the orbital drive mechanism and/or the scroll pumping element. For example, the electric drive motor may be hermetically enclosed with a fluid space. The second outlet 35 may dispense (i.e., output) fluid from the orbital drive mechanism and/or the scroll pumping element that flows through the motor housing 32 and/or the electric drive motor. This may provide cooling to the electric drive motor and components within the motor housing 32.

It should now be understood that the present disclosure is directed to scroll type pumps capable of meeting the need for a pump that can handle minimally subcooled liquid refrigerants and similar heat transfer fluids. The scroll pumps as provided herein capitalize on the relative motion between a meshed pair of scrolls that move in an orbital motion, with one scroll orbiting in a small circle and at low velocity relative to the other scroll. For example, and without limitation, a liquid pump of the present disclosure includes a pressure-tight housing, an inlet, an outlet, a scroll pumping element and an orbital drive mechanism. The scroll pumping element includes a fixed scroll component having one or more fixed scrolls and orbiting scroll component having one or more orbiting scrolls for fluid pumping. The fixed scroll component and the orbiting scroll component are arranged so as to be capable of providing pressurized fluid to a thrust bearing and prevent contact between the fixed scroll component and the orbiting scrolls component, and where the orbital drive mechanism is in fluid communication with the outlet.

The disclosed embodiments may be embodied in many different forms, and this disclosure should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention.

What is claimed is:

1. A pump, comprising:

an inlet, an outlet, and a scroll pumping element, wherein said scroll pumping element comprises:

a fixed scroll component having a single fixed scroll formed thereon, the single fixed scroll includes two fixed scroll portions and an orbiting scroll component having an orbiting base plane containing two distinct, non-contacting orbiting scrolls projecting therefrom, wherein the two fixed scroll portions include a first fixed scroll portion and a second fixed scroll portion and the two distinct, non-contacting orbiting scrolls including a first orbiting scroll and a second orbiting scroll; and a thrust bearing area formed by an arrangement of said fixed scroll component and said orbiting scroll component, wherein:

the first fixed scroll portion of said single fixed scroll and the first orbiting scroll of said two orbiting scrolls are arranged to pump a fluid from said inlet to said outlet, and the second fixed scroll portion of said single fixed scroll and the second orbiting scroll of said two distinct, non-contacting orbiting scrolls are arranged to provide a pressurized fluid to the thrust bearing area and prevent contact between said fixed scroll component and said orbiting scroll component.

2. The pump of claim 1 wherein a wrap length of at least one of said two orbiting scrolls is 0.75 wraps to 1.25 wraps long, and a wrap length of the single fixed scroll is 1.75 wraps to 2.25 wraps long.

3. The pump of claim 1 wherein a wrap length of at least one of said two orbiting scrolls is one wrap long and a wrap length of the single fixed scroll is two wraps long.

4. The pump of claim 1, further comprising an Oldham coupling associated with said orbiting scroll component.

5. The pump of claim 4, wherein said Oldham coupling comprises a wear-resistant coating.

6. The pump of claim 5, wherein said wear-resistant coating is hard anodized aluminum.

7. The pump of claim 1, further comprising an orbital drive mechanism in fluid communication with said outlet, said orbital drive mechanism comprising a drive shaft, two drive shaft bearings that support said drive shaft, and a radially compliant crank mechanism associated with said drive shaft.

8. The pump of claim 7, wherein said drive shaft bearings are radial ball bearings with ceramic balls.

9. The pump of claim 7 further comprising an orbital scroll bearing between said radially compliant crank mechanism and said orbiting scroll component.

10. The pump of claim 9, wherein said orbital scroll bearing is a radial ball bearing with ceramic balls.

11. The pump of claim 7, further comprising an electric drive motor mechanically coupled to said orbital drive mechanism.

12. The pump of claim 11, wherein said electric drive motor is hermetically enclosed within a fluid space.

13. The pump of claim 11, further comprising a second fluid outlet allowing fluid flow through said electric drive motor.

14. The pump of claim 1, wherein said fixed scroll component and said orbiting scroll component each have wear-resistant surfaces.

15. The pump of claim 14, wherein said wear resistant surfaces comprise or consist of hard anodized aluminum.

16. The pump of claim 1, wherein said pressurized fluid is the same fluid being pumped from said inlet to said outlet.

* * * * *